US005588314A

United States Patent [19]

Knezovich

[11] Patent Number: 5,588,314

[45] Date of Patent: Dec. 31, 1996

[54] SECURITY GATE LOCK ASSEMBLY

[76] Inventor: Anthony D. Knezovich, P.O. Box 1166, Rock Spring, Wyo. 82902

[21] Appl. No.: 580,437

[22] Filed: Dec. 27, 1995

[51] Int. Cl.[6] ..... E05B 67/38

[52] U.S. Cl. ..... 70/56; 70/129; 70/417; 292/148; 292/150

[58] Field of Search ..... 70/54–56, 129, 70/417, DIG. 29; 292/148, 150, 151, DIG. 13

[56] References Cited

U.S. PATENT DOCUMENTS

| | | | |
|---|---|---|---|
| 188,041 | 3/1877 | Burtis | 292/151 |
| 809,357 | 1/1906 | Clauser | 292/148 |
| 962,827 | 6/1910 | Gill | 292/148 X |
| 995,232 | 6/1911 | Edgar, Sr. | 292/148 X |
| 2,766,057 | 10/1956 | Treptow | 292/148 |
| 3,606,423 | 9/1971 | McCarthy | 292/148 |
| 4,512,105 | 4/1985 | Norton | 292/148 X |
| 4,802,351 | 2/1989 | Kojak | 70/56 |
| 5,102,022 | 4/1992 | Kaezovich | 224/42.25 |

FOREIGN PATENT DOCUMENTS

| | | | |
|---|---|---|---|
| 853639 | 12/1939 | France | 292/148 |
| 9966 | 7/1887 | United Kingdom | 292/150 |

*Primary Examiner*—Lloyd A. Gall
*Attorney, Agent, or Firm*—John E. Reilly

[57] ABSTRACT

A security locking device for releasably locking gates, doors and the like is made up of a bolt receiver and a locking bolt assembly, the locking bolt assembly including a slidable locking bolt which extends through a mounting tube for slidable movement between an extended locking position in the bolt receiver and a retracted, unlocked position removed from the receiver, and a locking wedge extends through slots in the mounting tube and locking bolt to retain the locking bolt in the locking position, the wedge in turn being locked securely in position by a locking member within the mounting tube. Mounting brackets are provided for tamper-proof attachment of the bolt receiver and locking bolt assembly to the respective members to be releasably locked.

14 Claims, 2 Drawing Sheets

SECURITY GATE LOCK ASSEMBLY

BACKGROUND AND FIELD OF INVENTION

This invention relates to locking devices; and more particularly relates to locking devices of the deadbolt variety which are particularly adaptable for use in securing gates, doors and other swinging or sliding panels in a reliable and efficient manner.

I have previously devised security locking devices and reference is made to U.S. Pat. No. 5,102,022 entitled LOCKING DEVICE FOR SPARE TIRE CARRIER. In my '022 patent, a security locking device includes a mounting tube upon which a spare tire is placed, and a locking wedge extends transversely through the mounting tube and through a locking bar and a padlock extends through the open end of the mounting tube to lock the wedge in position while enclosing the padlock to prevent tampering or cutting of the shackle or hasp portion of the lock.

There is similarly a need for tamper-proof locking devices in other applications, such as, gates or door panels either of the sliding or swinging variety in which the padlock can be made to be tamper-proof and the bolt receiver and locking bolt assembly being tamper-proof as well. At the same time, however, the padlock must be so mounted and arranged with respect to a locking bolt or bar as to prevent movement of the locking bolt between a locked and unlocked position. In this respect, it is important that the locking device be readily conformable for use in different security locking applications in which deadbolts are customarily employed.

SUMMARY OF THE INVENTION

It is therefore an object of the present invention to provide for a novel and improved security locking device.

It is another object of the present invention to provide for a security locking device which is of rugged but simplified construction and readily conformable for use in different applications and particularly in applications where the locking device is exposed to the elements.

It is a further object of the present invention to provide for a novel and improved security locking device for doors, gates and the like in which the locking member is mounted in such a way as to discourage tampering.

In accordance with the present invention, a security lock assembly has been devised for releasably locking one member, such as, a gate or door to another member, such as, a gate, fence or fixed vertical support and which comprises a bolt receiver mounted on one of the members, and a locking bolt assembly mounted on the other of the members, the locking bolt assembly including a fixed mounting tube, a slidable locking bolt extending through the tube for slidable movement between an extended locking position in which one end of the bolt is disposed in the receiver and a retracted, unlocked position in which the one end is removed from the receiver, a locking wedge extending through aligned slots in the mounting tube and locking bolt when the locking bolt is in the locking position, and a locking member for releasably engaging the wedge when it is positioned in the aligned slots so that when the locking member is in a locked position, the wedge is restrained against movement through the aligned slots and the locking bar is restrained against movement away from the locking position.

Preferably, the locking member is in the form of a padlock having a shackle portion directed inwardly through the mounting tube and into surrounding relation to the locking wedge so that when the shackle portion is locked the wedge is restrained against movement through the aligned slots. A lever arm on the locking bolt projects through a slot in the mounting tube for sliding the bolt in a customary manner between the locking and unlocked positions when the locking member is unlocked. Tamper-proof mounting brackets are provided for the bolt receiver and locking bolt assembly for attachment to the respective members to be releasably locked together.

The above and other objects of the present invention will become more readily appreciated and understood from a consideration of the following detailed description of a preferred form of the present invention when taken together with the accompanying drawings, in which:

DETAILED DESCRIPTION OF PREFERRED EMBODIMENT

Figures 1, 2, 3, 6:
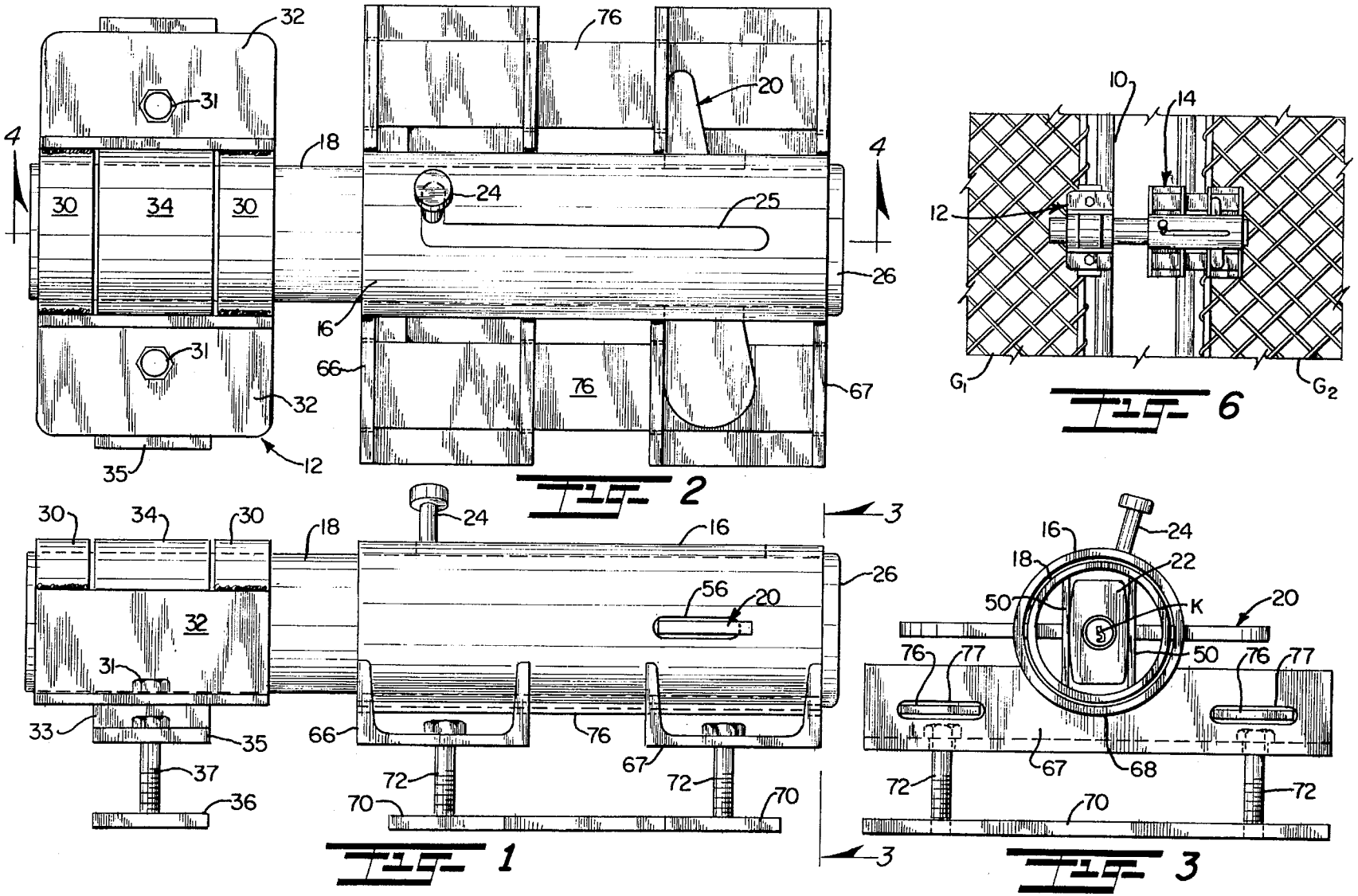
FIG. 1 is a top plan view of a preferred form of the present invention.
FIG. 2 is a front view in elevation of the form of invention shown in FIG. 1.
FIG. 3 is an end view taken about lines 3—3 of FIG. 1.
FIG. 6 is a view in elevation illustrating the preferred form of invention mounted on a gate.

There is illustrated in FIGS. 1 to 6 a preferred form of security locking device 10 which is broadly comprised of a bolt receiver 12 and a lock bolt assembly 14, the lock bolt assembly 14 being made up of a mounting tube 16, locking bolt member 18, locking wedge 20 insertable through aligned slots to be described in the mounting tube 16 and bolt 18, and a locking member 22 which is insertable through the mounting tube to retain the wedge 20 in position when the locking bolt is extended into locking relation to the bolt receiver 12. A lever 24 on the locking bolt is manually engageable and movable through an elongated slot 25 in the mounting tube to slide the locking bolt 18 between the locked and unlocked positions, and a cap 26 releasably covers one end of the mounting tube 16.

As a setting for the present invention, the security locking device 10 is conformable for use virtually in any application in which a sliding bolt can serve as the locking member and can be mounted externally rather than internally of the members to be locked. The device 10 is particularly adaptable for use on a gate, door or other swinging or slidable panels and in a manner to be described can be easily retrofit to different locking applications. For the purpose of illustration but not limitation, the preferred form of locking device 10 is hereinafter described in connection with a gate having a pair of swinging gate portions $G_1$ and $G_2$ and wherein the receiver 12 is mounted on one of the gate portions $G_1$ and the locking bolt assembly 14 is mounted on the other of the gate portions $G_2$. It will be readily appreciated, however, that the assembly can be equally as effectively employed with the locking bolt assembly mounted on a gate portion which either swings or slides with respect to a fixed vertical support, such as, a fence post.

Figure 4:
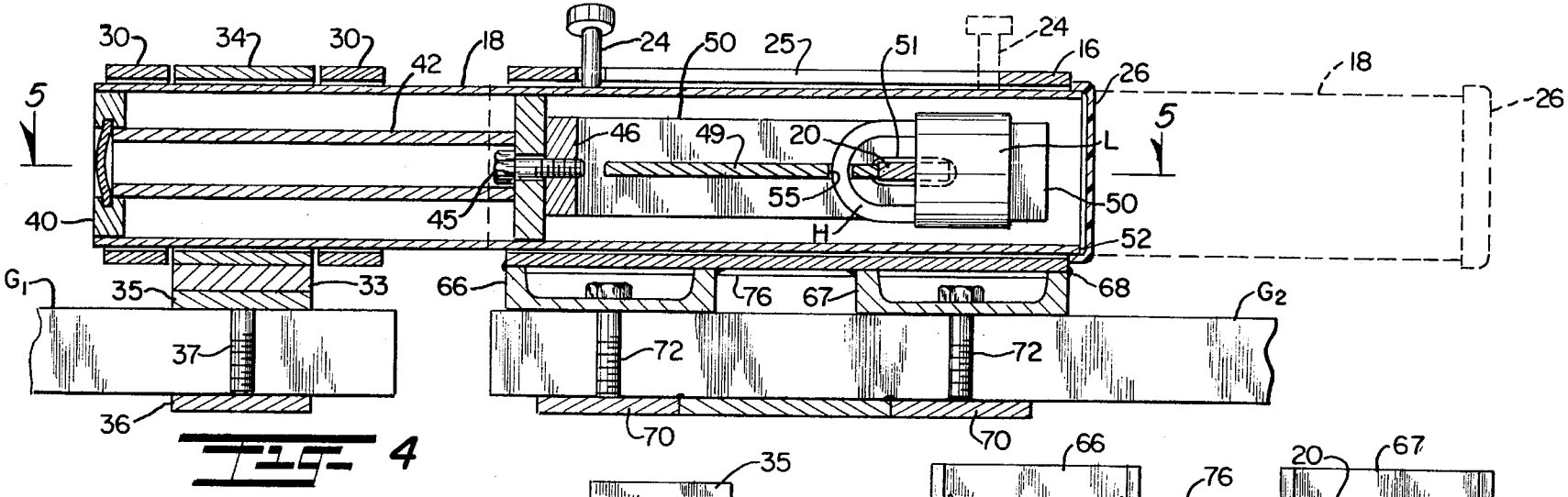
FIG. 4 is a longitudinal sectional view of the preferred form of locking device in accordance with the present invention.

In the preferred form, the bolt receiver 12 is made up of complementary sleeves, there being a pair of axially spaced and aligned sleeves 30 welded or otherwise permanently affixed to generally L-shaped mounting brackets 32 on diametrically opposed sides of the sleeve portions 30, and an intermediate sleeve 34 which is also permanently affixed on its underside to a relatively flat mounting plate or bracket 35 which extends transversely and beneath the mounting bracket 32. Spacers 33 are interposed between the mounting plate 35 and opposed brackets 32 through which suitable fasteners 31 are extended to clamp the mounting plate 35 and brackets 32 together with the sleeves 30 and 34 coaxially aligned. As shown in FIGS. 1 and 4, the bolt receiver may be mounted on the gate portion $G_1$ by means of a clamping plate 36 positioned on a side of the gate portion opposite to the mounting plate 35 and tightened into secure clamping engagement with the gate portion by means of threaded fasteners 37 which pass through openings in the gate portion into threaded engagement with the plate 36. In assembling the bolt receiver on the gate portion, the mounting plate 35 with its sleeve 34 is first connected to the clamping plate 36 in the manner described followed by positioning of the mounting brackets 32 and attached sleeves 30 over the mounting plate 35 and fastening thereto. In this way, when the locking bolt 18 is in its locked position extending through the complementary sleeves 30 and 34, the mounting brackets 32 will cover the ends of the fasteners 37 and cannot be removed from the covered position even by removal of the fasteners 31.

Referring to the locking bolt assembly 14, the locking bolt 18 is in the form of an elongated tube 38 having an annular disk 40 disposed at the leading end of the tube 38, and an inner spaced concentric sleeve 42 is centered within the tube for extension between the disk 40 and an intermediate disk 44 which is mounted within and fixed to an intermediate portion of the tube 38. The sleeve 42 is in turn affixed to the end of the disk 44 to define a passageway for insertion of a fastener 45 which is threaded through the disk 44 into engagement with a nut 46 on one side of the disk 44 opposite to the sleeve 42. A locking bar 48 is of generally H-shaped cross-sectional configuration including a web or cross member 49 joining spaced parallel flanges 50 which extend for the greater length of the remainder of the tube 38 from the disk 44 to an open end 52 of the tube 38. The web 49 extends only part way along the length of the locking bar to terminate at a point opposite to the inner edges of transversely aligned slots 54, but the flanges 50 extend beyond the web 49 to terminate in close proximity to the open end 52 of the tube 38. In this way, an open-ended slot is formed between the flanges 50 to receive a conventional padlock P having a tumbler portion L and a shackle portion H which passes through an opening 55 at the outer end of the web 49. Axially extending slots 56 in the mounting tube 16 are aligned with the slots 54 and with aligned slots 51 in the flanges 50 when the locking bolt is in its extended position.

Figure 5:
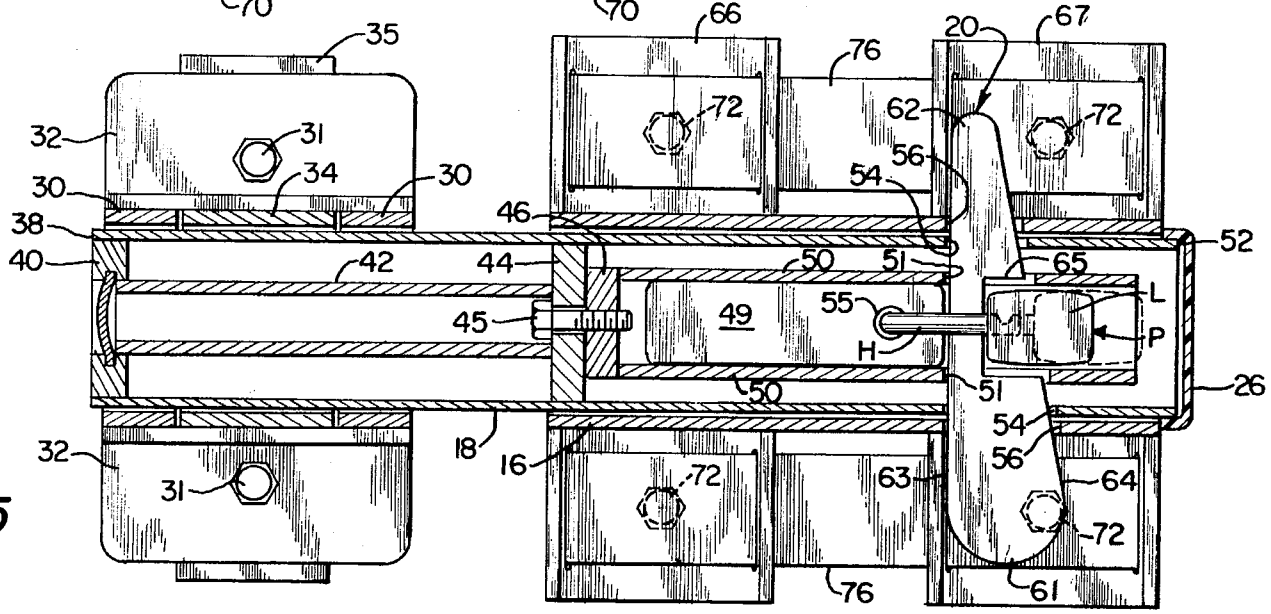
FIG. 5 is a sectional view taken about lines 4—4 of FIG. 2.

The locking wedge 20 extends transversely through the aligned pairs of the slots 54 and 56 and through the shackle portion H of the padlock P so that the shackle portion H straddles the locking wedge 20. The preferred form of wedge 20 is in the form of a flat plate which tapers from a wider end 61 into a narrow end 62, the wedge having a straight edge 63 and a tapered edge 64 with a recessed portion 65 on the tapered edge 64 facing the outer end 52 of the mounting tube so that the tumbler portion L of the padlock P will rest against or be seated on the inner edge of the recessed portion 65 when the padlock P is in the locked position, for example, as shown in FIG. 5. In this manner, the locking wedge 20 is restrained against release until the padlock P is unlocked by means of a key inserted into a key slot K at one end of the padlock facing outwardly through the open end 52 and the tumbler can be moved to the dotted line position shown in FIG. 5.

The mounting tube 16 is welded or otherwise permanently affixed to a pair of mounting brackets 66 and 67 which are disposed in axially spaced relation to one another. The mounting brackets 66 and 67 are correspondingly formed of generally U-shaped channels and which extend transversely of the length of the mounting tube, the channels having upwardly facing recessed or saddle portions 68 to which a lower arcuate surface of the mounting tube 16 is permanently affixed.

In order to mount the locking bolt assembly 14 on a fence or other support surface, a generally flat clamping member 70 is disposed on one side of the gate portion $G_2$ opposite to the channels 66 and 67 so that undersides of the channels when placed flush against the other side of the gate can be fastened by means of lag bolts 72 extending from the channels into threaded engagement with threaded bores in the clamping member 70. Accordingly, when the fasteners 72 are tightened the mounting tube 16 is securely clamped to the gate portion $G_2$. Once assembled as described, a pair of cover plates 76 extend through slots 77 in the side walls of the channels 66 and 67 and may be suitably fixed and placed over the ends of the fasteners 72, such as by welding the ends of the plates 76 to the slots so that access cannot be gained to the fasteners for their removal.

The bolt receiver 12 and lock bolt assembly 14 are assembled as described onto the respective gate portions $G_1$ and $G_2$ such that the locking bolt 18 is aligned in facing relation to the bolt receiver 12 and is freely slidable into the bolt receiver when the gate portions $G_l$ and $G_2$ are in a closed position. In order to lock the bolt 18 in the extended locking position, the locking wedge 20 is inserted transversely through the slots 54 and 56 and through the shackle portion H until the recessed portion 65 is aligned with the tumbler portion L. The tumbler portion L is then forced inwardly until the shackle portion H is inserted into locking engagement with the tumbler portion. The cap 26 is then placed over the end of the mounting tube 16 and may be either a pressfit engagement or threaded onto the end of the mounting tube. In releasing the locking bolt 18 from locking engagement with the receiver 12, the cap 26 is removed and a key inserted into the tumbler portion to unlock the shackle portion whereupon the tumbler portion L will move away from the shackle portion H and the wedge 20 is then free to be removed from the aligned slots 54 and 56. The locking bolt 18 is retracted by advancing the lever or slide member 24 through the elongated slot 25 until the locking bolt 18 is fully withdrawn from the receiver. The gate portions $G_1$ and $G_2$ are then free to swing away from one another into the open position.

Although the security locking device has been described specifically in relation to its mounting on a pair of swinging gates, it will be evident that the device 10 is equally effective with a gate assembly in which a single gate portion is movable by swinging into and away from a fixed surface, such as, a wall or fence. The locking device 10 is equally effective with a door panel in which the locking bolt assembly 14 is mounted on the external surface of the door and the bolt receiver 12 may simply take the form of an opening or bore into the door jamb which is aligned with the locking bolt. The locking device 10 is equally effective with sliding doors or panels, such as, garage doors, in which the panel is slidable in a vertical direction with respect to a fixed support.

It is therefore to be understood that while a preferred form of invention has been herein set forth and described, various modifications and changes may be made in the construction and arrangement of parts comprising the preferred form of invention without departing from the spirit and scope thereof as defined by the appended claims and reasonable equivalents thereof.

I claim:

1. A gate lock assembly adapted for releasably locking a gate to a fixed vertical support comprising:

a bolt receiver for being fixed to one of said gate and said support; and a locking bolt assembly for being mounted on the other of said gate and said support including:

(a) a fixed mounting tube;

(b) a slidable locking bolt extending through said mounting tube for slidable movement between an extended locking position in which one end of said locking bolt is disposed in said receiver and a retracted, unlocked position in which said one end is removed from said receiver;

(c) a locking wedge extending through aligned slots in said mounting tube and said locking bolt when said locking bolt is in the extended position; and (d) a locking-member for releasably engaging said wedge when said wedge is positioned in said aligned slots whereby when said locking member is locked said wedge is restrained against movement through said aligned slots and said locking bolt is retained in the extended locking position.

2. A gate lock assembly according to claim 1, wherein said locking bolt includes a manually engageable lever arm projecting through a slot in said mounting tube for sliding said locking bolt between the extended locking position and retracted unlocked position.

3. A gate lock assembly according to claim 2, wherein said slot for said lever arm in said mounting tube is elongated in the direction of slidable movement of said locking bolt.

4. A gate lock assembly according to claim 2, wherein said lever arm takes the form of a radially extending bolt on an external surface of said locking bolt.

5. A gate lock assembly according to claim 1, wherein said locking bolt is of generally cylindrical configuration.

6. A gate lock assembly according to claim 1, wherein said locking member extends through an opening at one end of said locking bolt and wherein said opening is in direct communication with an aligned slot in said locking bolt.

7. A gate lock assembly according to claim 1, wherein said wedge includes a recess aligned with an aligned slot in said locking bolt to receive said locking member when said locking bolt is in the extended locking position.

8. A security locking device for releasably locking one member against movement with respect to another member, comprising:

a bolt receiver for being fixed to one of said members; and a locking bolt assembly for being mounted on the other of said members and including:

(a) a fixed mounting tube;

(b) a slidable locking bolt extending through said mounting tube for slidable movement between an extended locking position in which one end of said locking bolt is disposed in said receiver and a retracted, unlocked position in which said one end is removed from said receiver;

(c) a locking wedge extending through aligned slots in said mounting tube and said locking bolt when said locking bolt is in the extended position; and (d) a locking member for releasably engaging said wedge when said wedge is positioned in said aligned slots whereby when said locking member is locked said wedge is restrained against movement through said aligned slots and said locking bolt is restrained in the extended locking position.

9. A security locking device according to claim 8, wherein said locking bolt includes a manually engageable protuberance projecting through a slot in said mounting tube for sliding said locking bolt between the extended locking position and retracted unlocked position.

10. A security locking device according to claim 9, wherein said slot for said protuberance in said mounting tube is elongated in the direction of slidable movement of said locking bolt.

11. A security locking device according to claim 9, wherein said protuberance takes the form of a radially extending bolt on an external surface of said locking bolt.

12. A security locking device according to claim 8, wherein said locking bolt is of generally cylindrical configuration.

13. A security locking device according to claim 8, wherein said locking member extends through an opening at one end of said locking bolt and wherein said opening is in direct communication with an aligned slot in said locking bolt.

14. A security locking device according to claim 8, wherein said wedge includes a recess aligned with an aligned slot in said locking bolt to receive said locking member when said locking bolt is in the extended locking position.

* * * * *